United States Patent [19]

Sayles

[11] Patent Number: 4,513,513

[45] Date of Patent: Apr. 30, 1985

[54] MICROWAVE DRYING OF AMMONIUM PERCHLORATE GRINDING SPHERES

[75] Inventor: David C. Sayles, Huntsville, Ala.

[73] Assignee: The United States of America as represented by the Secretary of the Army, Washington, D.C.

[21] Appl. No.: 550,435

[22] Filed: Nov. 10, 1983

[51] Int. Cl.[3] ..... F26B 3/34

[52] U.S. Cl. ..... 34/1; 34/68; 219/10.55 R; 219/10.55 M

[58] Field of Search ..... 34/1, 68, 52; 219/10.55 R, 10.55 M

[56] References Cited

U.S. PATENT DOCUMENTS 3,434,220 3/1969 Forster ..... 34/1

4,340,806 2/1984 Hopkins ..... 34/1

*Primary Examiner*—Larry I. Schwartz

*Attorney, Agent, or Firm*—John H. Raubitschek; Werten F. W. Bellamy; Jack W. Voigt

[57] ABSTRACT

Disclosed is a method of microwave drying of ammonium perchlorate grinding spheres. A preferred embodiment of the method employs a tunnel oven in combination with a microwave generator having an appropriate power supply. The tunnel oven receives microwave energy through transmission ducts in communication with a channeling device to distribute microwave energy over the grinding spheres to be dried. A preheated air supply facilitates moisture removal from the tunnel oven after the moisture adhered or occluded to the grinding spheres' surfaces is evaporated from the grinding spheres as a result of molecular vibrations of the water molecules after they absorb the microwave energy. A predetermined microwave frequency range and a predetermined drying time are employed to more efficiently remove adhered or occluded moisture from carbide grinding spheres as compared to conventional convection drying.

2 Claims, 1 Drawing Figure

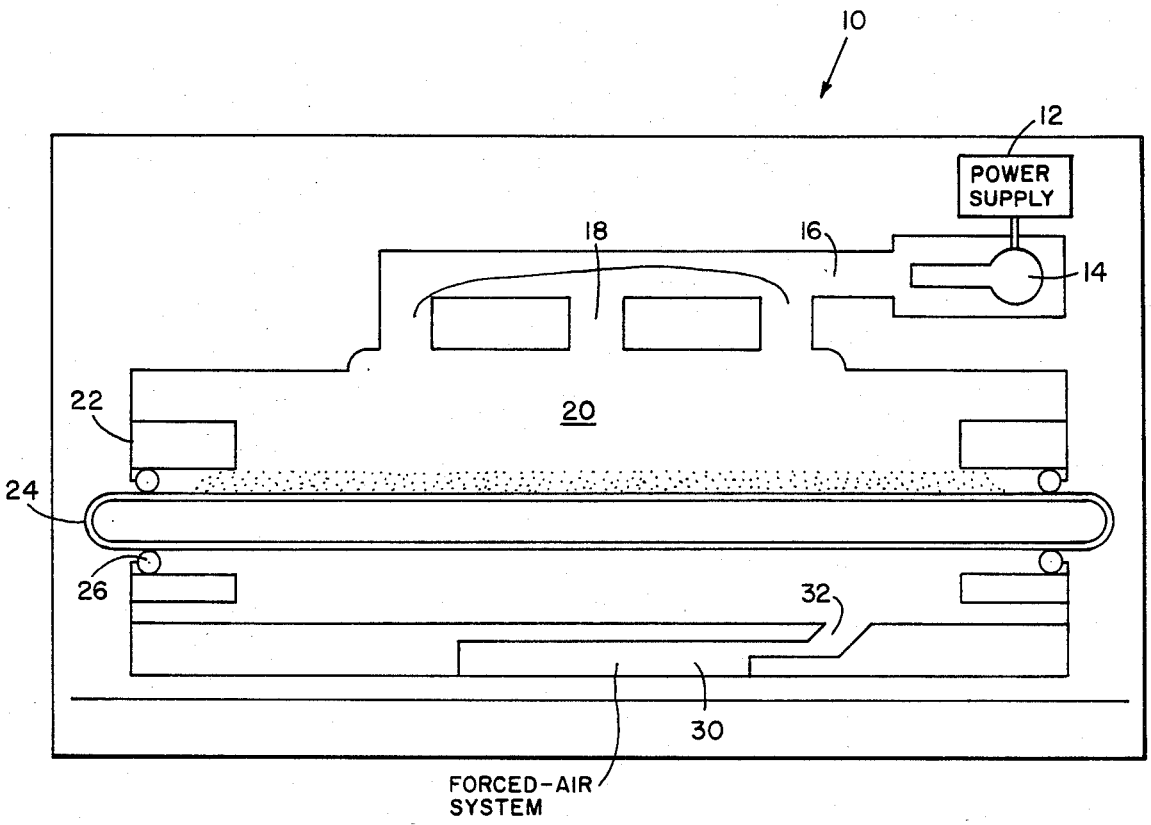
10
12
POWER SUPPLY
18
16
14
22
20
24
26
32
30
FORCED-AIR SYSTEM

MICROWAVE DRYING OF AMMONIUM PERCHLORATE GRINDING SPHERES

DEDICATORY CLAUSE

The invention described herein may be manufactured, used, and licensed by or for the Government for governmental purposes without the payment to me of any royalties thereon.

BACKGROUND OF THE INVENTION

Grinding of ammonium perchlorate to submicron size is accomplished generally by grinding in a mill referred to in the trade as SWECO (Southwestern Engineering Company). The grinding spheres used in a SWECO mill are silicon carbide or aluminum carbide. During grinding of the ammonium perchlorate moisture pick-up causes adhered or occluded moisture build-up near the spheres' surfaces which require periodic moisture removal procedures for the grinding spheres.

Presently, the method for the removal of adhered or occluded moisture from these spheres involves heating the spheres in a convection oven for 24 hours at 180°-200° F. The production-type, 280 gallon SWECO mill uses about 1600-2000 pounds of spheres.

The major drawback to the drying of spheres by means of a convection oven is the loss of a large amount of heat because of the necessity of having to heat the entire sphere to an elevated temperature in order for the adsorbed moisture to be driven off.

A more efficient drying or moisture removal system, particularly one which does not require that the entire spheres be heated, would be advantageous to the art which employs grinding spheres to reduce ammonium perchlorate to submicron size.

Therefore, an object of this invention is to provide a drying system whereby moisture removal is achieved without heating the entire grinding spheres to an elevated temperature.

Another object of this invention is to remove moisture from grinding spheres by a method whereby the drying time is drastically reduced.

A further object of this invention is to provide a drying method which requires a shorter residence time in the dryer and yields a greater throughput.

SUMMARY OF THE INVENTION

The grinding spheres, silicon carbide or aluminum carbide, which are employed in a SWECO mill when grinding ammonium perchlorate to submicron size accumulate adhered or occluded moisture that has to be removed by periodic drying. Moisture removal is effected in accordance with this invention by microwave drying.

Microwave drying effectively removes moisture without the requirement of having to heat the grinding spheres to a high temperature required in convection drying. Microwave drying is especially applicable in removing polar solvents from solid materials whose surface-to-volume ratio is low and solids which cannot be tumbled, such as carbide grinding spheres. Since water is an especially good microwave absorber, drying time is drastically reduced to a period of less than 30 minutes. In the microwave dryer, the microwaves need not penetrate the carbide spheres, but need only to be absorbed by the water molecules, and the molecular vibrations which are induced cause the evaporation of the moisture.

The microwave dryer is comprised of a tunnel oven into which the carbide spheres are metered onto an adjustable-speed, continuous, meshed conveyer belt manufactured from a suitable dielectric material which is compatible with microwave energy. The spheres are passed into the tunnel section of the microwave dryer through a microwave trap which is constructed of plastic pipe which contain circulating water. The tunnel is generally constructed of 304 Stainless Steel. The microwave radiation is introduced into the tunnel through aluminum ducting. The microwave energy is generated by a 30-kW magnetron which generates microwaves of frequencies of 2450 MHz and 915 MHz.

BRIEF DESCRIPTION OF THE DRAWING

The drawing depicts a microwave dryer which illustrates the associated functional parts of the dryer in a schematic representation.

DESCRIPTION OF THE PREFERRED EMBODIMENT

The drawing is a schematic representation of a typical microwave dryer 10 which is adequate for moisture removal when operated at atmospheric pressure to remove moisture from carbide spheres employed to grind ammonium perchlorate. The microwave dryer includes a power supply 12, a microwave generator 14 inclosed within transmission duct 16 which direct microwaves through a channeling or distributing device 18 into a tunnel oven 20. Within the tunnel oven are operating controls and safety interlocks 22 and a conveyer belt 24 for receiving and discharging the carbide spheres through microwave traps 26. The aluminum or silicon carbide spheres are metered onto a conveyer belt 24 which has an adjustable-speed, a continuous and meshed construction of a suitable dielectric material having compatibility in a microwave environment. A forced-air system 30 supplies preheated air flow through a supply duct system 32 to facilitate moisture removal via discharge ducts (not shown) from the tunnel oven operated at atmospheric pressure.

In operation, the drying of the carbide spheres is achieved by metering the spheres onto an adjustable-speed, continuous, meshed conveyer belt which is manufactured from a suitable dielectric, such as, fiberglass. The spheres are passed through a microwave trap which is constructed of two plastic pipes which contain circulating water. The spheres are then passed into the tunnel section of the microwave dryer. The tunnel is generally constructed of 304 Stainless Steel. The microwave radiation is introduced into the tunnel through aluminum ducting 16. The microwave generator 14 is a standard 30-kW magnetron tube which is a self-excited, oscillator, that, given the proper voltage, filament power and magnetic field requires no adjustment or tuning. The microwave generator consists of a power supply with a transformer to convert line voltage to high voltage direct current required to operate the magnetron tube.

In the tunnel, the radiation heating of the water adsorbed on the surface of the spheres causes it to evaporate, and it is carried away by a stream of heated air which is fed into the dryer.

The microwave dryer is operated at a lower temperature and its smaller size cuts down on the heat losses through the dryer walls, and hence increases energy efficiency. The efficiency was demonstrated by the following: With the conventional hot-air dryer, 55% of the total energy input was lost through the walls of the dryer whereas wall losses from the microwave dryer amounted to only 21% of the total energy input. As a consequence, the overall energy efficiency was calculated to be 40% as compared to 25% for the conventional hot-air dryer. This would translate into a major energy savings of 40–55%.

I claim:

1. A method of removing occluded moisture from the surfaces of ammonium perchlorate grinding spheres selected from silicon carbide and aluminum carbide, said method effecting the removal of occluded moisture to prevent its absorption by ammonium perchlorate during a grinding procedure, said method comprising:

(i) providing a tunnel oven having in combination therewith a microwave generator with an appropriate power supply, said tunnel oven arranged to receive microwave energy through transmission ducts in communication with a channeling device to distribute said microwave energy over said grinding spheres to be dried, said tunnel oven provided with a heated air supply from a forced-air system to facilitate moisture removal during drying, and said tunnel oven provided with microwave traps and operating controls and safety interlocks to permit grinding spheres to be safely conveyed in and out of said tunnel oven by conveyor means having an adjustable-speed and a continuous meshed dielectric surface having compatibility with a microwave energy environment;

(ii) metering grinding spheres onto said conveyor means to provide a residence time and throughput quantity in and through said tunnel oven to achieve moisture removal in accordance with a predetermined drying time;

(iii) exposing said grinding spheres to microwave energy having a predetermined frequency range from about 915 megahertz to about 2450 megahertz for a predetermined drying time of up to about 30 minutes to subject adhered or occluded moisture on said grinding spheres to molecular vibration to cause vaporization of said moisture; and (iv) continuously removing said vaporized moisture by a stream of heated air which is fed through said tunnel oven at a predetermined pressure.

2. The method of claim 1 wherein said predetermined pressure is atmospheric pressure.

* * * * *